United States Patent [19]

Martin

[11] 4,027,740

[45] June 7, 1977

[54] MULTI-CHAMBER MUFFLER

[76] Inventor: James F. Martin, P.O. Box 302, Hondo, Tex. 78861

[22] Filed: June 15, 1976

[21] Appl. No.: 696,421

Related U.S. Application Data

[63] Continuation of Ser. No. 548,190, Feb. 10, 1975, abandoned.

[52] U.S. Cl. ..... 181/68; 181/70

[51] Int. Cl.[2] ..... F01N 1/08

[58] Field of Search ..... 181/57–58, 181/63, 68–70

[56] References Cited

UNITED STATES PATENTS

| | | | |
|---|---|---|---|
| 981,584 | 1/1911 | Miller | 181/70 X |
| 1,695,375 | 12/1928 | Heather | 181/68 X |
| 3,101,811 | 8/1963 | Kelly | 181/57 X |
| 3,811,531 | 5/1974 | Forssman | 181/50 |

FOREIGN PATENTS OR APPLICATIONS

| | | | |
|---|---|---|---|
| 416,247 | 9/1934 | United Kingdom | 181/70 |
| 913,609 | 12/1962 | United Kingdom | 181/58 |

*Primary Examiner*—Lawrence R. Franklin
*Attorney, Agent, or Firm*—Warren H. Kintzinger

[57] ABSTRACT

A multi-chamber muffler having an input exhaust gas cyclone chamber receiving exhaust gas input from an exhaust pipe at an outlet location as related to a baffle wall, and in combination with the slant of the baffle wall generating cyclonic vortex turbulance flow of the exhaust gases delivered thereto. This cyclonic vortex action with enhanced conversion of CO to $CO_2$ in the on-fire temperature exhaust gases is further enhanced by a hurdle-top pass opening to a following expansion chamber where even more combination of CO to the $CO_2$ occurs. Turbulance mixing of gas products is enhanced in the second expansion chamber with a back wall having a hurdle top pass to a successive expansion chamber having a back wall with a hurdle bottom pass. The next successive chamber has a hurdle top pass at the top to a final chamber having a bottom tail pipe outlet passing $CO_2$, O, C, and carbon pellets as the final output to the tail pipe.

9 Claims, 3 Drawing Figures

MULTI-CHAMBER MUFFLER

Figure 1:
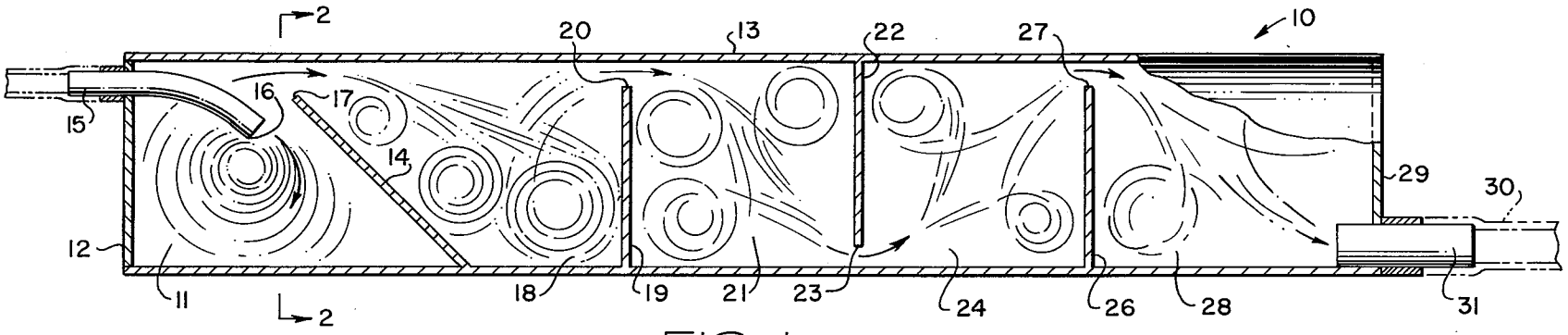

This is a continuation of application Ser. No. 548,190, filed Feb. 10, 1975 now abandoned.

This invention relates in general to mufflers, and in particular to a muffler doing much more than merely muffling the sound of an internal combustion engine, wherein more complete combining of the products of combustion are attained via passage of the exhaust products through a cyclonic vortex turbulence chamber and successive expansion chambers separated by pass over and under baffel wall hurdles.

Emission of pollutents in the exhaust of internal combination engines has been a significant problem with the tremendous number of vehicles on the road today, particularly in metropolitan areas. Objectionable exhaust products from vehicle engines may be minimized if more complete combustion can be attained before the exhaust passes to the atmosphere. Transformation of CO, in exhaust, to $CO_2$, so that the final emission is primarily $CO_2$, O, C, and carbon pellets is much to be desired, particularly in meeting emission improvement standards being imposed through legislation in recent years. One approach to attaining more complete combustion of exhaust emissions, that appeared recently, is the use of catalitic converter material equipped mufflers. These, however, can be more expensive than conventional mufflers used heretofore, and, with platinum used as a catalytic material, imposition of a requirement for use of unleaded fuel—only to avoid poisioning contamination of the catalyst in such catalytic mufflers.

It is therefore, a principal object of this invention to provide an internal combustion engine muffler that not only muffles engine noise, but that helps to complete the conversion of exhaust emissions to the more completely oxidized form and thereby more complete conversion of CO to $CO_2$ before release to the atmosphere.

Another object is the attainment of improved more completely burned (i.e. oxidized) emissions without resorting to use of catalytic converters.

A further object is to provide improved exhaust gas turbulence and flow for desired improvement in products of engine emission through a muffler of rugged improved, yet relatively low cost construction.

Still another object is the attainment of improved internal combustion engine aspiration with lower exhaust back pressures being imposed by such an improved automotive muffler.

Features of the invention useful in accomplishing the above objects include, in a multi-chamber muffler, an initial exhaust gas cyclone chamber with slanted rear baffle wall (slanted forwardly, relative to the muffler case bottom, at approximately 45°), with an exhaust pipe extended into the chamber having the pipe outlet so positioned and angled as to optimize generation of a cyclonic vortex turbulence flow. The cyclonic vortex action of on-fire temperature exhaust gasses is further enhanced by the hurdle top pass opening at the top of the slanted rear baffle chamber wall, in achieving enhanced conversion of CO to $CO_2$. Further expansion and turbulence mixing of the hot exhaust gasses occur with gas flow through the successive chambers of the muffler to final passage of $CO_2$, O, C, and carbon pellets to and out through the bottom positioned tail pipe to the atmosphere.

Specific embodiments representing what are presently regarded as the best modes of carrying out the invention are illustrated in the accompanying drawing.

Figure 2:
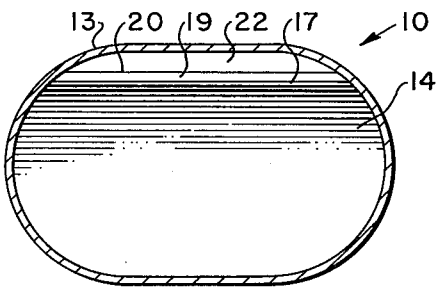
Figure 3:
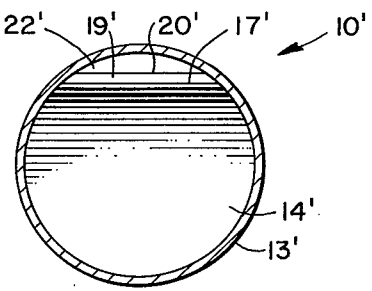

In the drawing:

FIG. 1 represents a partially cut away muffler container with baffles defining a successive series of chambers with over and under baffle hurdles for successive throughgas-flow through the chambers of the muffler, and with an initial exhaust gas cyclone chamber having a forwardly slanted rear baffle wall and an exhaust pipe extension outlet positioned and directed for optimized cyclonic vortex movement of on-fire temperature exhaust gasses within the cyclone chamber;

FIG. 2, a view taken substantially along line 2 — 2 of FIG. 1, through the forward initial cyclone chamber of the muffler, looking rearwardly therefrom; and FIG. 3, a similar view, looking rearwardly from the cyclone chamber of a cylindrical in-transverse section muffler as opposed to the modified oval, in-transverse section muffler of FIGS. 1 and 2.

Referring to the drawing:

The muffler 10 of FIGS. 1 and 2 is shown to have a plurality of internal chambers, separated by internal baffles with an initial chamber 11 defined by front end wall 12, the muffler casing 13 and a baffle wall 14 fastened in place, as by welding, to the interior of muffler casing 13 at a forward slant of approximately 45° from the bottom of the muffler casing 13. Chamber 11 actually forms a cyclonic vortex turbulence and expansion chamber with an exhaust input pipe 15 mounted to extend through the top of the muffler front-end wall and have its output end 16 located within the chamber 11 relative to the slanted baffel wall 14, to aid in developing the desired cyclonic vortex turbulence flow of exhaust gasses delivered from input pipe 15 within the chamber, and with flow from the chamber. The cyclonic vortex turbulence flow action with enhanced conversion of CO to $CO_2$ in the on-fire temperature exhaust gasses is further enhanced by the positioning of the hurdle-top 17 pass opening to a following expansion chamber 18 where even more conversion of CO to $CO_2$ occurs. It should also be noted that the additional energy release attained through the thermal chemical action in attaining more complete oxidation of the exhaust gasses also contributes to intensifying the cyclonic vortex turbulence flow action. This intensified cyclonic vortex flow within chamber 11 can also contribute to improved aspiration of an internal combustion engine delivering exhaust gasses to the muffler 10, with proper positioning of the exhaust gas input pipe 15 output end at a lowered pressure region of the cyclonic vortex within the chamber, particularly, with the input gasses being fed in, tangentially to the vortex center, on the cyclonic flow-aiding side thereof.

With continuing expansion of gasses in passage to expansion chamber 18, there is a cooling of the gasses, with some being adiabatic expansion cooling and some being radiation cooling to the muffler casing, and conduction cooling through the casing wall. Expansion chamber 18 is defined at the front, in FIG. 1, by slanted baffle wall 14, the muffler casing 13 and a rear baffle wall 19 having a hurdle top 20 pass opening to a following muffler chamber 21. Chamber 21 has a rear baffle wall 22 with, in this instance, a hurdle bottom 23 pass opening to the next chamber 24 that, in turn, has a rear baffle wall 26, with a hurdle top 27 pass opening to the final muffler chamber 28 that is enclosed at the rear by muffler end wall 29. The tail pipe 30 connection tube 31 is mounted in the bottom of the muffler rear end wall 29 to facilitate outward flow of exhaust gasses and products, including carbon flakes and pellets that form and precipitate from the exhaust gas as it cools with passage through the muffler 10. Generally, the exhaust gasses do not cool to the point that carbon flakes and pellets form until the exhaust gasses and products are moving through the successive turbulence flow chambers 21, 24, and 28, after expansion chamber 18, in a labyrinth path flow by the chamber baffle walls 20, 22, and 27. Thus, by the time the exhaust products are passed to and through muffler outlet connection tube 30 and the tail pipe 30 to the atmosphere, the exhaust is primarily $CO_2$, with some O, some C, and carbon flakes and pellets. Exhaust product flow within the muffler generally follows the direction arrows shown in FIG. 1, along with turbulent action such as typically indicated in the drawing.

With a cylindrical muffler 10′ shown in transverse section in FIG. 3, the same as the transverse section of FIG. 2, for the muffler of FIG. 1, the corresponding components are given like, primed, numbers with the muffler in side-section being substantially the same as the showing of FIG. 1. Obviously, the baffle pass-over openings and pass-under openings in various embodiments would be varied in conforming to throughflow requirements imposed on the mufflers in various shapes. Further, chamber-to-chamber baffle pass openings may be optimized along with muffler size for predetermined throughflow-rate requirements imposed by specific engines. It should also be noted that these mufflers do not make sulfuric acid, nor sulfuric acid mist in the air, such as is occurring with catalytic converter equipped mufflers.

Whereas, this invention is illustrated and described with respect to preferred embodiments thereof, it should be realized that various changes can be made without departing from essential contributions to the art made by the teachings hereof.

I claim:

1. In a muffler: a plurality of exhaust gas transfer chambers including, an initial cyclonic vortex chamber having a forward wall, muffler casing, and baffle wall means mounted within the muffler casing, with a pronounced slant toward said forward wall; an exhaust gas expansion chamber within the muffler case, flow-wise, behind said initial cyclonic vortex chamber; exhaust gas input means positioned to feed exhaust gases to said initial cyclonic vortex chamber; exhaust gas flow outlet means for passage of exhaust gas products from said expansion chamber, ultimately to the atmosphere; wherein said baffle wall means is a common wall between said initial cyclonic vortex chamber and said exhaust gas expansion chamber with the slant toward said forward wall forming an acute angle with muffler casing on the initial cyclonic vortex chamber side of the baffle wall means; with said baffle wall means having a hurdle end edge defining, with said muffler case, opening means for passage of exhaust gas in flow from said initial cyclonic vortex chamber to said exhaust gas expansion chamber; said exhaust gas input means comprising a pipe extended through the forward wall of the muffler and into the confines of said vortex chamber to an outlet end termination near the center of said vortex chamber, said outlet end having an opening with dimension substantially smaller than one-half the vertical dimension of said vortex chamber and radially displaced from the chamber longitudinal axis toward the hurdle end edge of said baffle wall, said outlet end being positioned and directed to aid cyclonic vortex gas flow within said initial cyclonic vortex chamber; and, wherein the outlet end of said exhaust gas input means pipe is located at a relatively lower pressure area within the confines of and near the center of the gas flow cyclonic vortex established within said vortex chamber when exhaust gas is being fed from said exhaust gas input means pipe and through the muffler.

2. The muffler of claim 1, wherein said baffle wall means forming said common wall is slanted toward said forward muffler wall at an angle with the muffler case of less than 60°.

3. The muffler of claim 1, wherein the pronounced slant of said baffle wall means toward said forward wall forms an acute angle of approximately 45° with the muffler case.

4. The muffler of claim 1, wherein said opening means for passage of exhaust gas in flow from said initial cyclonic vortex chamber is located in position for receiving gas flow from the outer circumferential region of the cyclonic vortex in gas movement of said initial cyclonic vortex chamber.

5. The muffler of claim 4, wherein positioning of the outlet end of the exhaust gas input means pipe, the slant of said baffle wall, and the position of the opening means for passage of exhaust gas in flow from said initial cyclonic vortex chamber cooperatively aid in generation of cyclonic vortex exhaust gas flow within the chamber.

6. The muffler of claim 4, wherein said baffle wall means forming said common wall is slanted toward said forward muffler wall at an acute angle of approximately 45° with the muffler case.

7. The muffler of claim 4, formed with an additional plurality of serially successive exhaust gas product turbulence flow chambers separated by a series of baffle walls having alternately oriented gas passing baffle wall hurdle edge and muffler case defined gas flow passing openings for labyrinth type turbulent chamber-to-chamber exhaust gas flow through the muffler.

8. The muffler of claim 7, wherein the first two baffle wall hurdle edge and muffler defined openings in the direction of gas flow through the muffler are at the top of the baffle walls, and the following chamber wall openings alternate down, up, down.

9. The muffler of claim 8, wherein a final tail pipe outlet is located at the bottom of the muffler rear wall.

* * * * *